US008079865B1

(12) United States Patent
Rundle

(10) Patent No.: US 8,079,865 B1
(45) Date of Patent: Dec. 20, 2011

(54) SYSTEMS AND METHODS OF COUPLING ELECTRICAL CONDUCTORS

(75) Inventor: Kenneth P Rundle, Independence, OH (US)

(73) Assignee: NDI Medical, LLC, Cleveland, OH (US)

( * ) Notice: Subject to any disclaimer, the term of this patent is extended or adjusted under 35 U.S.C. 154(b) by 0 days.

(21) Appl. No.: 12/958,077

(22) Filed: Dec. 1, 2010

(51) Int. Cl.
*H01R 11/20* (2006.01)

(52) U.S. Cl. ..... 439/393

(58) Field of Classification Search ..... 439/393, 439/411, 413, 415, 431, 793, 791
See application file for complete search history.

(56) References Cited

U.S. PATENT DOCUMENTS 3,249,908 A * 5/1966 Fuller et al. ..... 439/393
3,579,172 A * 5/1971 Clark ..... 439/415
3,861,772 A * 1/1975 Shaffer ..... 439/393
4,768,963 A * 9/1988 Barron ..... 439/101
5,030,134 A * 7/1991 Plosser ..... 439/434
5,152,701 A * 10/1992 Polidori ..... 439/791
5,266,057 A * 11/1993 Angel et al. ..... 439/724
5,769,656 A * 6/1998 Bamburg ..... 439/431
6,676,436 B2 * 1/2004 Gaidosch ..... 439/393

* cited by examiner

*Primary Examiner* — Tulsidas C Patel
*Assistant Examiner* — Phuong Nguyen
(74) *Attorney, Agent, or Firm* — Ryan Kromholz & Manion, S.C.

(57) ABSTRACT

Systems and methods are provided for coupling a plurality of electrical conductors, such as wires. A connector is provided including a plurality of bores or channels formed into a preferably unitary connector body, wherein at least a portion of one or more of the bores or channels intersects at least a portion of another of the bores or channels. The bores or channels are preferably formed along bore axes, which may be coplanar. A method according to the present invention includes inserting an insulated electrical conductor into a connector body and rotating a conductive rotational member threaded into a bore or channel formed in a connector body so as to electrically contact the conductive portion of the insulated conductor and at least one other electrically conductive surface.

17 Claims, 8 Drawing Sheets

SYSTEMS AND METHODS OF COUPLING ELECTRICAL CONDUCTORS

BACKGROUND OF THE INVENTION

The present invention relates generally to electrical connectors, and more specifically to electrical connectors configured to electrically couple at least one insulated electrical conductor to another electrically conductive surface.

Prior insulation displacement connectors (IDCs) may be found in a variety of configurations. One popular configuration is a blade or vampire tap configuration. In such configuration, insulated electrical conductors (e.g., wires), often required to be identical size or gauge, are placed in a connector housing. When the connector housing is closed, and usually locked, the electrical conductors are placed in electrical communication with each other, or with an electrical terminal connector plug or jack. Such electrical communication is achieved by one or more electrically conductive blades that slice through the insulation of the insulated conductor, usually at a single longitudinal location along the conductor, and physically contact the electrically conductive material of the conductor (e.g., one or more copper or other conductive strands of material).

One disadvantage of prior IDCs is a normal restriction on conductor size. That is, most prior devices cannot accommodate a large variation of size between the conductors to be coupled. Where a large deviation between conductor size is attempted, past IDCs have problems either displacing insulation adequately from all conductors and/or the IDC housings do not lock properly.

Another disadvantage of prior IDCs is a restriction on conductor types. Other connectors presume that, where two conductors are to be connected, for example, the conductors are not only the same size, as described above, but are of the same construction (e.g. solid conductor, stranded conductor, coiled conductor, coaxial, etc.). Thus, prior devices may be unable to accommodate a first conductor of one construction and a second conductor of a different construction, for example.

Still another disadvantage of IDCs is that they may not be suited for use in moist ambient environments. Many past IDC housings, even after being locked, thereby forming the desired electrical connection, remain penetrable by water and/or water vapor, usually through unsealed housing cracks or joints. While such housings may be substantially sufficient for applications where the connector will be kept in a dry environment or where a secondary housing is provided, it may not be useful in situations where electrical connection under water or for use in moist environments, such as a shower, steam room, etc.

Accordingly, the art of insulation displacement connectors would benefit from improved systems and methods of coupling electrical conductors that may solve one or more of the stated disadvantages, or may provide other advantages.

SUMMARY OF THE INVENTION

Embodiments of the present invention provide improved systems and methods of coupling electrical conductors.

An embodiment of a device for coupling electrical conductors according to the present invention includes a connector body and a first conductive surface disposed at least partially within the connector body. A coupling element is movably engageable at least partially within the connector body, and a first aperture is formed into the connector body and adapted to receive an insulated electrical conductor. At least a first portion of the coupling element extends into the first aperture and at least a second portion of the coupling element is engageable with the first conductive surface.

According to one aspect of a device according to the present invention, the connector body is formed from an electrically insulative material.

According to another aspect of a device according to the present invention, the connector body is substantially parallelepiped in shape and has at least one imperforate outer surface, but preferably has a plurality of imperforate outer surfaces, such as two or three.

According to yet another aspect of a device according to the present invention, the coupling element may be movable between a first position and a second position. In the first position, the coupling element is in electrical communication with the first conductive surface, and in the second position, the coupling element is spaced from and removed from electrical communication with the first conductive surface.

According to a further aspect of a device according to the present invention, the first aperture is formed along a first aperture axis and the device further includes an engagement aperture formed into the connector body along an engagement aperture axis. The coupling element may be movable within the engagement aperture and the engagement aperture and the first aperture intersect at a first intersection location. In one embodiment, the engagement aperture axis and the first aperture axis are substantially parallel. In other embodiments, such axes are formed obliquely with respect to each other.

According to still another aspect of a device according to the present invention, where the coupling element is movable between the first and second position, as mentioned above, when the coupling element is in the second position, the first aperture, the first intersection location and at least a portion of the engagement aperture are configured to allow passage of an insulated electrical conductor therethrough.

According to yet a further aspect of a device according to the present invention, the device may further include a second aperture formed into the connector body, wherein the second aperture intersects the engagement aperture at a second intersection location. In one embodiment, the second intersection location may be spaced from the first intersection location by a conduction span distance, in which case, the coupling element is preferably a substantially cylindrical stud formed along length disposed along a stud axis, wherein the stud length is greater than the conduction span distance. The stud may be provided as threadably engaged with the connector body in the engagement aperture.

An embodiment of a method according to the present invention is a method of coupling electrical conductors. Such embodiment includes the step of providing a device including a connector body having a first aperture formed therein and adapted to receive an insulated electrical conductor. The device further includes a first conductive surface disposed at least partially within the connector body and a coupling element movably engageable at least partially within the connector body. At least a first portion of the coupling element extends into the first aperture and at least a second portion of the coupling element is engageable with the first conductive surface. The method also includes the step of inserting an insulated electrical conductor into the first aperture, the insulated electrical conductor comprising one or more electrical conductors at least partially surrounded by one or more insulation layers. The method further includes a step of moving the coupling element relative to the connector body, and as a result of the moving step, placing the insulated electrical conductor in electrical communication with the first conductive surface.

According to one aspect of a method according to the present invention, the conductive element of the provided device is a conductive stud extending between and including a first end and a second end.

According to another aspect of a method according to the present invention, where the coupling element is a conductive stud, the conductive stud may include stud threads mateable with body threads provided in the connector body, wherein the stud threads protrude radially at least partially into the first aperture. Where stud threads are provided, the moving step comprises the step of applying a rotational force to the first end of the stud, thereby causing longitudinal movement of the stud within the connector body. Also preferably as a result of the moving step, the stud threads penetrate one or more of the insulation layers and the stud threads are placed in electrical contact with one or more of the electrical conductors. Further, preferably as a result of the moving step, the second end of the stud may abut and be placed into electrical communication with the first conductive surface.

DESCRIPTION OF THE PREFERRED EMBODIMENT

Figure 1:
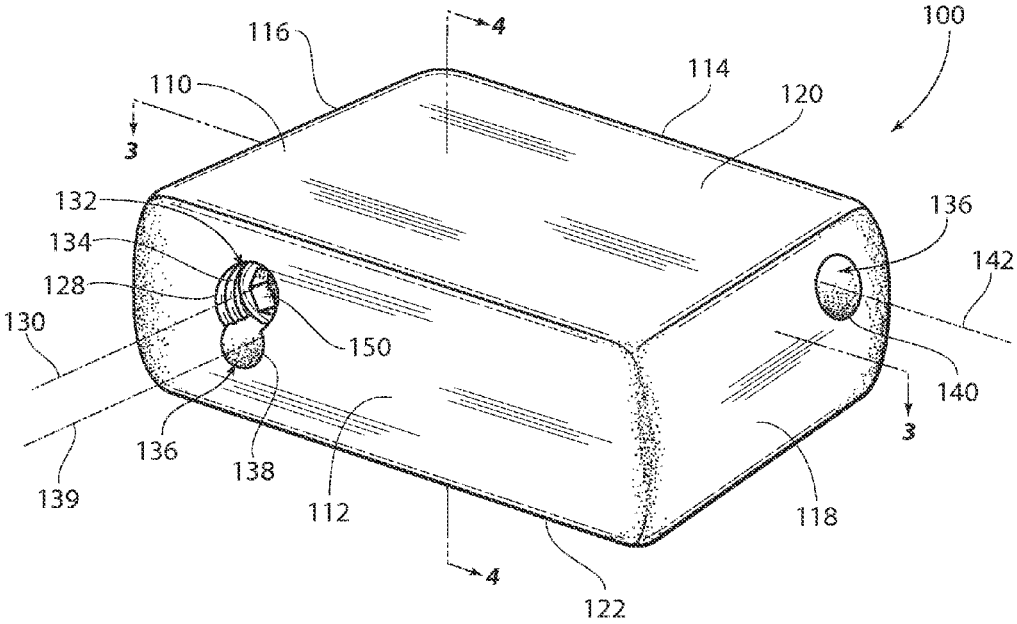
FIG. 1 is a perspective view of a first embodiment of an insulation displacement connector according to the present invention.
Figure 2:
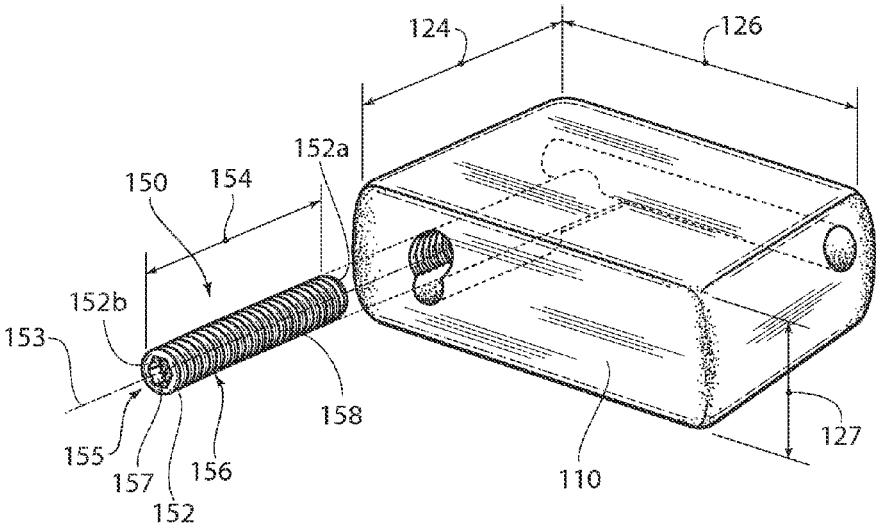
FIG. 2 is a partial assembly view of the connector of FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Turning now to the Figures, a first embodiment 100 of a coupling device or connector according to the present invention is shown in FIGS. 1-4. The connector 100 generally includes a connector body 110 and a coupling element 150. The connector body 110 may be formed of any desirable shape, but is preferably formed substantially as a parallelepiped having a front surface 112 oppositely disposed from a rear surface 114, a left surface 116 oppositely disposed from a right surface 118, and a top surface 120 oppositely disposed from a bottom surface 122. The front surface 112 may be situated at a body width 124 from the rear surface 114, the left surface 116 may be situated at a body length 126 from the right surface 118, and the top surface 120 may be situated at a body thickness 127 from the bottom surface 122. The body width 124 is preferably about 0.25 inches to about 0.75 inches, more preferably about 0.30 inches to about 0.50 inches, and most preferably about 0.40 inches. The body length 126 is preferably about 0.50 inches to about 1.00 inches, more preferably about 0.50 inches to about 0.75 inches, and most preferably about 0.625 inches. The body thickness 127 is preferably about 0.15 inches to about 0.50 inches, more preferably about 0.20 inches to about 0.30 inches, and most preferably about 0.25 inches.

While the connector body 110 may be formed of any desirable material that may be selected for a given use, the connector body 110 is preferably formed from an electrically insulative material, such as a thermoplastic material, which may be a USP Class VI medical grade plastic material. A preferred material may be selected from the Ultem® family of amorphous thermoplastic polyetherimide (PEI) available from Sabic Innovative Plastics Holding BV, of Pittsville, Mass., and also of the Netherlands. A preferred material is Ultem 1000. Indeed, the connector body 110 may be machined from Ultem bar stock having a desired diameter, such as about 0.625 inches, which may cause the left surface 116 and right surface 118 to be generally convex along the body width 124.

Formed into the connector body 110 is at least one engagement aperture, bore or channel 128, formed along an engagement axis 130. The engagement aperture 128 is provided with an engagement means 132, such as threads 134, to cooperate with the coupling element 150. The engagement aperture 128 may be formed through the connector body 110, such as through the entire width 124, as shown. The threads 134 may be formed during casting of the body 110 or in a machining process after the body 110 has been cast or machined.

Also formed into the connector body 110 is at least one conductor aperture, bore or channel 136. In the embodiment shown, a first conductor channel 138 is formed into the front surface 112 of the connector body 110, the first conductor channel 138 being formed along a first conductor axis 139 which may be disposed at least substantially parallel to the engagement axis 130. The first conductor channel 138 is preferably a smooth reentrant bore, which is formed at a distance from or relation to the engagement aperture 128 so as to intersect the engagement aperture 128. As shown, the first conductor axis 139 is disposed substantially parallel to the engagement axis 130, and spaced therefrom by a distance that is less than the sum of the radius of each of the axes 130,139 such that the first conductor channel 138 overlaps the engagement aperture 128 longitudinally along a length thereof. A portion 138*a* of the first conductor channel 138 preferably extends through the connector body 110, and such arrangement may be desirable to provide for conductor length adjustment. The portion 138*a* may extend substantially obliquely to a tangent of threads 158 provided on the stud 152, as further described below.

In the first embodiment 100, a second conductor aperture, bore or channel 140 is formed along a second conductor axis 142. While the second conductor bore 140 may extend through the entire connector body 110, such as through the entire body length 126, the second conductor bore 140 is preferably a smooth reentrant bore, which at least partially intersects the engagement aperture 128. The second conductor axis 142 may be coplanar with the engagement axis 130, but is preferably obliquely skew to the engagement axis 130 at a desired angle 144. Thus, in the embodiment 100 shown, using the engagement axis 130 as a reference, the first conductor axis 139 is disposed substantially parallel to and below the engagement axis 130, while the second conductor axis 142 is disposed obliquely skew to and above the engagement axis 130. The angle 144 at which the second conductor bore 140 may be formed skew to the engagement axis 130 is preferably greater than 45 degrees and less than about 135 degrees, and is preferably about 90 degrees. However, as described in connection with later embodiments, the second conductor axis 142 may be disposed substantially parallel (about zero or about 180 degrees) to the engagement axis 130.

The coupling element 150 is preferably formed as a conductive stud 152 formed between a first end 152*a* and second end 152*b* along a stud axis 153 for a stud length 154. The stud length 154 is preferably less than a dimension of the connector body 110 that is parallel to the engagement axis 130. Indeed, when the coupling element 150 is operatively positioned to couple a plurality of conductors, the coupling element 150 is preferably situated completely within all perimeters of the connector body 110, so as to inhibit electrical conduction through the coupling element 150 through accidental outside contact. The stud 152 preferably has mating engagement means 156, such as threads 158, formed along at least a portion of the stud length 154, to cooperate with the engagement means 132 provided in the engagement aperture 128, such as at least a portion of the threads 134, provided in the engagement aperture 128. A preferred material for the stud 152 is stainless steel, copper, or any other conductive material. The first end 152 is preferably at least partially formed as a substantially planar surface disposed preferably orthogonally to the stud axis 153. The second end 152*b* is preferably provided with a tool engagement surface 155, which may include a female hexagonal socket 157, as shown, or other engagement surface.

To use the first embodiment 100 of a connector according to the present invention, a plurality of insulated conductors 900 are inserted into the connector 100, and electrically coupled by the coupling member 150. A first insulated conductor 902 may include a electrically conductive portion 904 circumferentially surrounded by an electrically insulative portion 906. The conductive portion 904 may be a solid conductor, such as a wire of suitable gauge, a plurality of conductors forming a straight stranded wire, or one or more coiled wires having an at-rest turns-per-inch count. Electrically coupled to the conductive portion 904 is an electrically conductive terminal 908, such as a stainless steel terminal that may be crimped onto the conductor 904 and/or the insulation 906. At an end opposite the terminal 908, the conductor 902 may be terminated with a custom or conventional electrical plug, socket, jack, etc., such as a conventional IS-1 connection. A second insulated conductor 912 may include a electrically conductive portion 914 circumferentially surrounded by an electrically insulative portion 916. The conductive portion 914 may be a solid conductor, such as a wire of suitable gauge, a plurality of conductors forming a straight stranded wire, or one or more coiled wires having an at-rest turns-per-inch count, and is preferably the latter. At an end of the second conductor 912 distal from the connector 100, the conductor 912 may terminate in a desired fashion, such as with a custom or conventional electrical plug, socket, jack, etc., or with a functional termination such as a stimulating electrode, and more preferably a stimulating electrode configured to be anchored in animal muscle tissue.

Figure 6A:
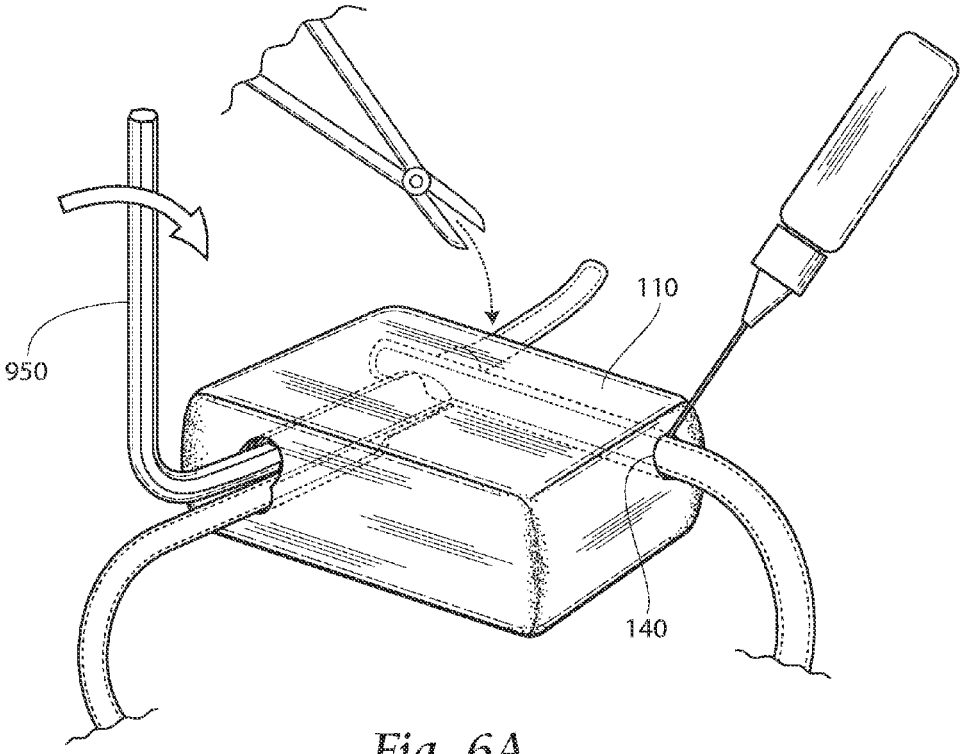
FIG. 6A is a first perspective view of the assembly of FIG. 5 further assembled.

To use the connector 100, the first conductor 902 is inserted into the second conductor bore 140 such that the terminal 908 is disposed at least partially within the engagement aperture 128. Preferably, the terminal 908 abuts a closed end of the second conductor bore 140 to register the terminal 908 in a desirable position to help reduce guesswork as to positioning. The first conductor 902 may be secured to the connector body 110, such as with adhesive or sealant, or with a nonpenetrating set screw. Preferably, along at least a portion of the second conductor bore 140, void space that may exist between the insulator 906 and the bore 140 is filled with an electrically insulative substance, such as silicone. The process of disposing the first conductor 902 at least partially within the connector body 110 may be performed generally prior to product packaging, such as sterile product packaging, or such assembly may be performed by a user upon opening one or more sterile packages containing the first conductor 902 and the connector body 110. Preferably, though not necessarily, after the first conductor 902 is inserted and/or positioned, the second conductor 912 is preferably inserted into the first conductor channel 138 and at least partially into the engagement aperture 128. If the engagement aperture 128 extends entirely through the connector body 110, the second conductor 912 may be pulled through the body 110 to a desired length. Once the conductors 902,912 are at a desired position, the coupling member 150 is placed into electrical communication with both conductive portions 904,914. While the coupling member 150 may be completely removed from the body 110 to allow insertion of the second conductor 912, the coupling member 150 is preferably prepositioned at least partially within the engagement aperture 128 prior to the insertion of the second conductor 912. Such prepositioning may be done generally at the time of manufacture, and the member 150 may be held substantially rotationally stationary in the engagement aperture 128 by, for example, a drop of silicone. One way in which such electrical communication may be achieved is by the threads 158 cutting through the insulation 916 of the second conductor 912 and the first end 152*a* abutting the terminal 908 of the first conductor 902. The stud 152 may be advanced, such as with a standard L-shaped hex, or other wrench 950 (as shown in FIG. 6A), in the engagement aperture 128 to a desired position, such as for an instructed number of turns or to a desired torque. Some deformation or deflection of the terminal 208 may occur. Once operatively positioned, the stud 152 preferably is disposed completely within all perimeters of the connector body 110.

As mentioned, the conductors 900 may be one or more coiled wires having an at-rest (unstretched) turns-per-inch count. The threads 158 on the coupling member 150 are preferably positioned at a thread pitch that approximates (preferably +/−10%) the at-rest turns-per-inch count of a (multi-)coiled conductor 900.

Figure 6B:
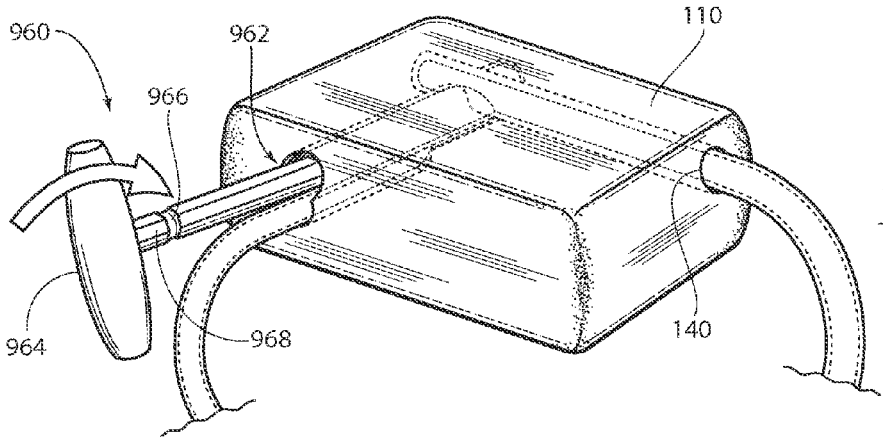
FIG. 6B is a second perspective view of the assembly of FIG. 5 further assembled, showing a second embodiment of a wrench.

As mentioned, the stud 152 may be turned until a desired torque is reached. As shown in FIG. 6B, a T-style wrench 960 may be used. While the wrench 960 may preferably be a conventional torque wrench, such as a clutched, or "clicking", torque wrench, the wrench 960 may alternatively comprise a unitary molded wrench having a tool end 962 oppositely disposed from a handle 964. Between the tool end 962 and the handle 964 is preferably a stress riser portion 966, which is adapted to fail at a predetermined torque, such as preferably about 1 to about 14 inch-oz., more preferably about 3 to about 12 inch-oz., and most preferably about 4 inch-oz., thereby at least substantially separating the handle 964 from the tool end 962 which is engaged with the stud 152. Accordingly, it can be assured that the stud 152 will be tightened to a torque within a predetermined range of torques, and substantially to a predetermined torque. The desired torque may be different for different types and/or sizes of conductors. Accordingly, a variety of breakaway torque wrenches 960 may be provided, each calibrated to a different breakage torque. Although the wrench 960 is shown as having a T-handle, it is to be appreciated that other handle configurations are possible, such as straight and extending substantially obliquely from the working shaft 968.

Figure 6C:
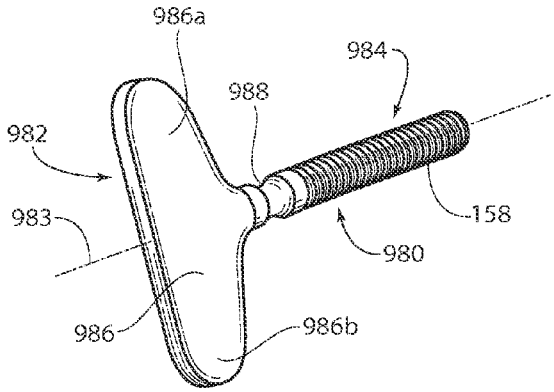
FIG. 6C is a perspective view of an alternative wrench/stud combination.

Additionally or alternatively, the tool end of a wrench may be provided as being anchored to the stud 152, such as by being adhered thereto or formed integrally therewith. In such embodiment, the stress riser portion may be formed substantially at the second end 152*b* of the stud 152. An example of a combined stud and torque wrench, or wrench-stud 980 can be seen in FIG. 6C. The embodiment 980 preferably includes a wrench portion 982 and a stud portion 984, where the stud portion 984 may be substantially the same as or identical to the prior stud 152 discussed. While other orientations are within the scope of the present invention, the wrench portion 982 preferably includes a winged handle 986 including a first wing 986*a* and a second wing 986*b* extending preferably radially outwardly, and disposed substantially circumferentially opposite, from the stud axis 983. Disposed between the handle 986 and threads 158 disposed on the stud 984 is a stress riser portion 988, which is adapted to destructively fail at a predetermined torque, such as those torques mentioned above, caused by the handle 986 rotating about the stud axis 983. It is envisioned that, if a wrench-stud 980 is used, the failed portion of the stress riser 988 will nest within the engagement aperture 128, generally within the connector body 110 and recessed past a surface of the body 110, such as the front surface 112. The wrench portion 982 may be formed of a desirable plastic material, as may the stress riser portion 988. The stud portion 984 is preferably formed, as described above, of an electrically conductive material. The wrench portion 982 and the stud portion 984 may be adhered or otherwise secured together.

Figure 3:
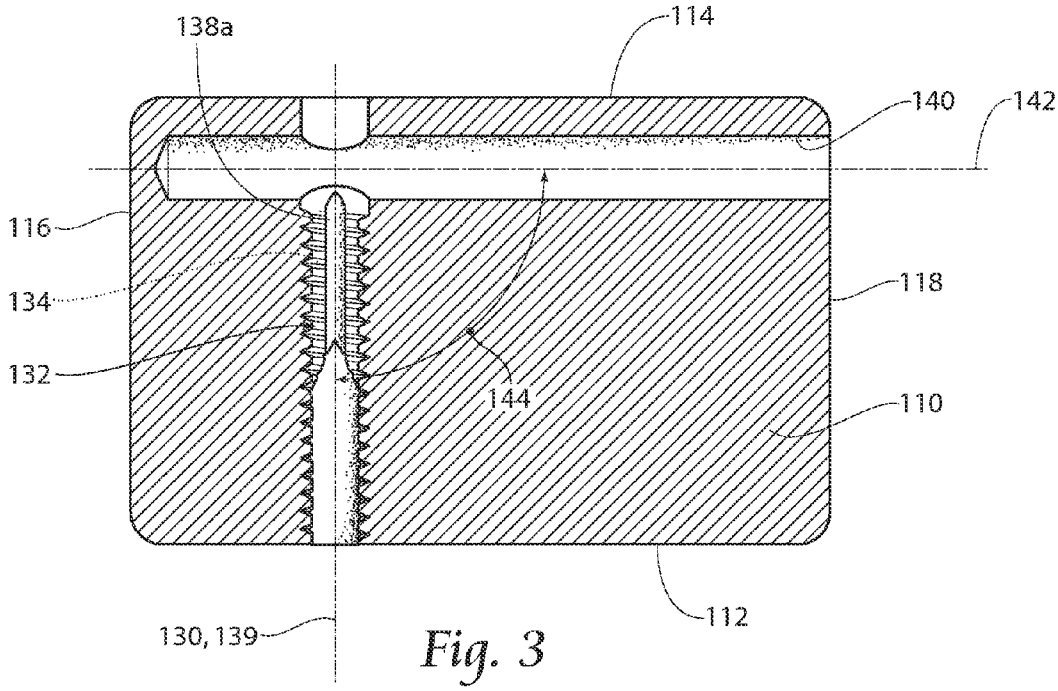
FIG. 3 is a cross-section view taken along line 3-3 of FIG. 1.
Figure 4:
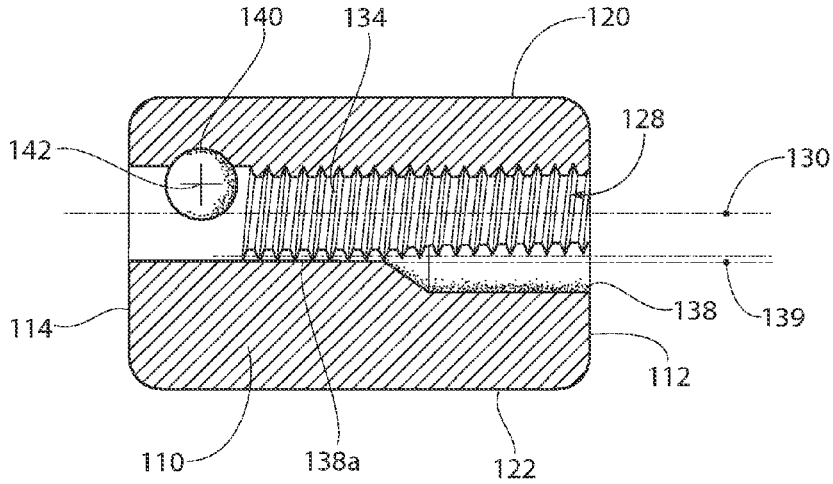
FIG. 4 is a cross-section view taken along line 4-4 of FIG. 1.
Figure 5:
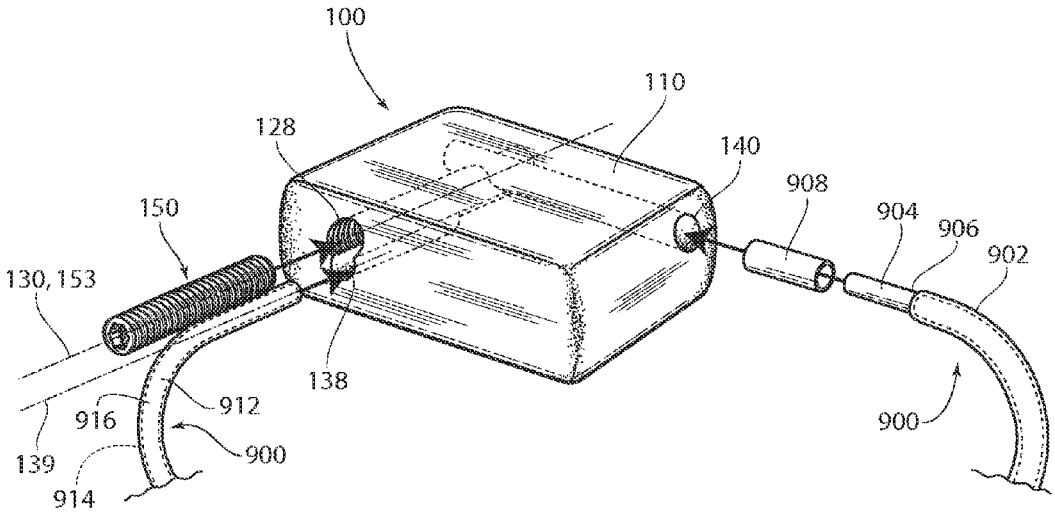
FIG. 5 is a second partial assembly view of the connector of FIG. 1.
Figure 7A:
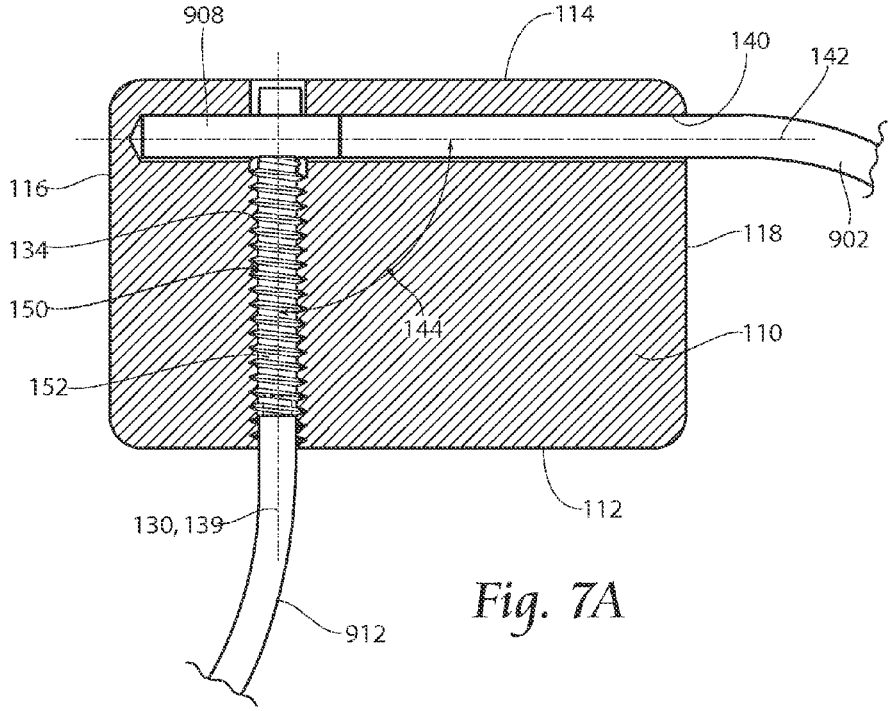
FIG. 7A is the same cross-section view as FIG. 3, further showing conductors installed.
Figure 7B:
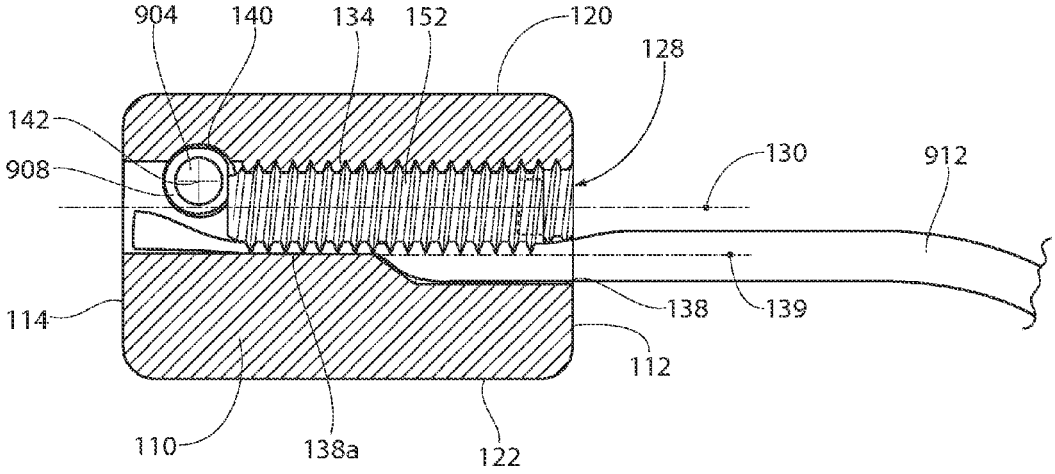
FIG. 7B is the same cross-section view as FIG. 4, further showing conductors installed.

FIGS. 7A and 7B are the same views as FIGS. 3 and 4, except showing the conductors 900 installed into and engaged by the connector 100, as previously described.

Figure 8:
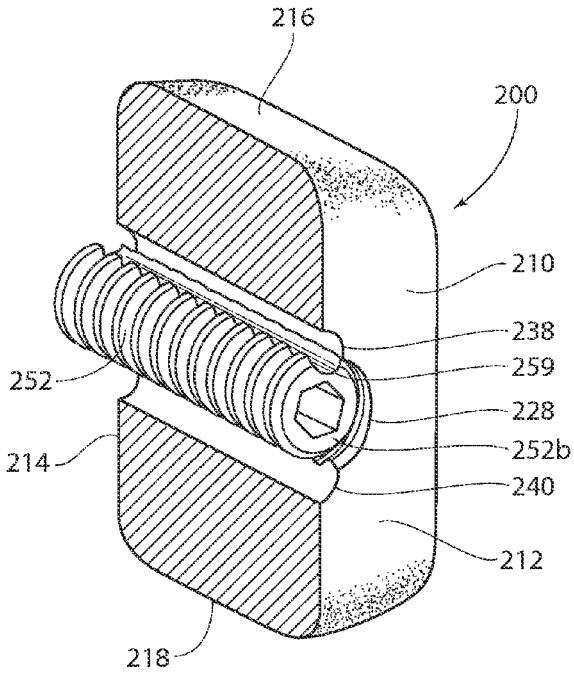
FIG. 8 is a perspective partial cross-section assembly view of a second embodiment of an insulation displacement connector according to the present invention.

FIG. 8 depicts a second embodiment 200 of an electrical connector according to the present invention, where like numerals refer to like structure from the first embodiment 100. In this embodiment, the threads 258 of the stud 252 are placed in electrical communication with the conductive portions 904,914 of both conductors 900. The first conductor channel 238 is formed through the connector body 210, through the front surface 212 and through the rear surface 214, preferably substantially parallel to the engagement aperture 228. Additionally, the second conductor channel 240 is formed preferably diametrically opposite, across the engagement aperture 228, from the first conductor channel 228. The coupling member 250 of this embodiment is largely similar to the coupling member 150 of the first embodiment 100, but the stud 252 is preferably provided with at least one insertion channel 259 formed along its length and extending radially inwardly from the major diameter of the threads 258 of the stud 252. To use the embodiment, a first conductor 902 may be inserted into the second conductor channel 240 and the stud 252 may be advanced into the engagement aperture 228 to secure the first conductor 902 in place. The insertion channel 259 may be substantially aligned with the first conductor channel 228, to ease insertion of the second conductor 912 into or through the connector 100. Once the second conductor 912 is in a desirable position, an electrical coupling of the two conductive portions 904,914 may be advantageously achieved preferably by a quarter turn (about 90 degrees) of the stud 252 by a wrench or other means.

Figure 9:
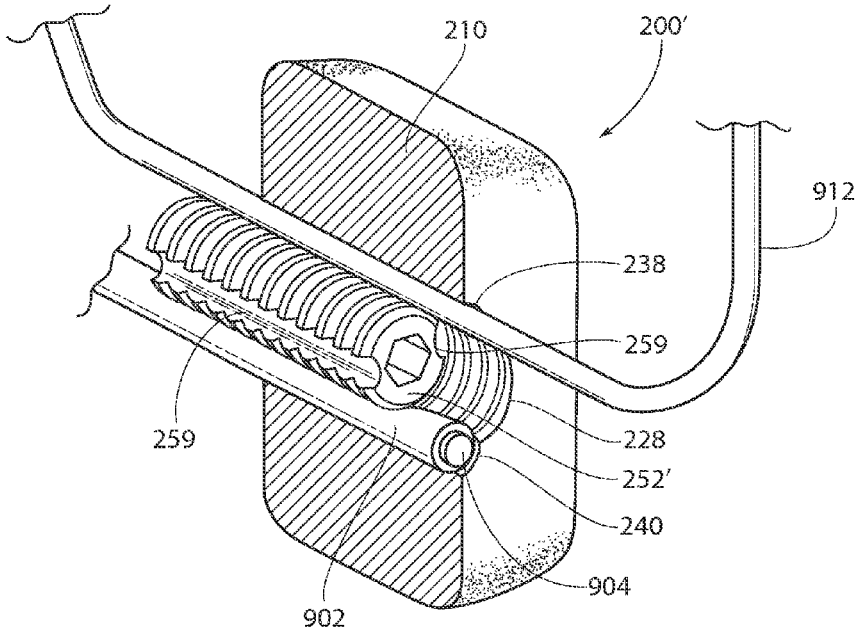
FIG. 9 is the embodiment of FIG. 8, including a second embodiment of a coupling member.

FIG. 9 depicts a modified embodiment 200' of the embodiment 200 of FIG. 8, where like numerals refer to like structure from the first embodiment 100, further showing a second insertion channel 259 formed on the stud 252'. This embodiment may be preferred in situations in which both conductors 900 are required to be sized and/or inserted into the connector at the time of coupling the conductive portions 904,914. Such embodiment still provides quarter-turn connectivity, but advantageously allows custom sizing of the lengths of the conductors 900.

Figure 10:
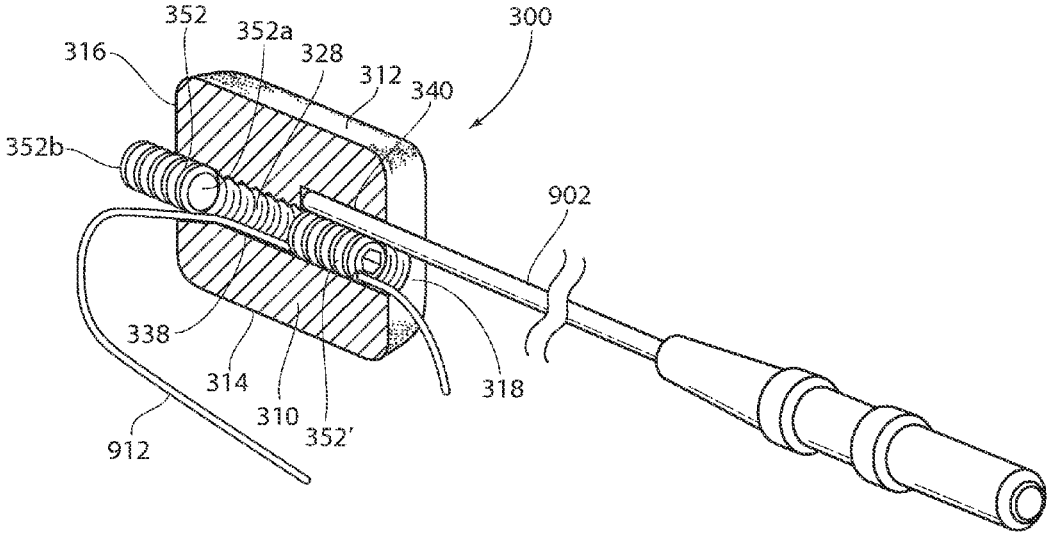
FIG. 10 is a perspective partial cross-section assembly view of a third embodiment of an insulation displacement connector according to the present invention.

A third embodiment 300 of a connector according to the present invention is shown in FIG. 10, where like numerals refer to like structure from the first embodiment 100. This embodiment 300 is much like the second embodiment 200, but the second conductor bore 340 extends only partially through the connector body 310. A first stud 352' having an insertion channel 359 may engage and retain the first conductor 902, and electrically communicate with its conductive portion 904. The insertion channel 359 may be aligned with the first conductor channel 338. After insertion of the second conductor 912 into or through the conductor channel 338, a second stud 352 may be inserted from an opposite end of the engagement aperture 328, and be advanced through the aperture 328 to abut the first stud 352'. Thus, the first end 352*a* of each stud would abut the other, while the threads 358 from the first stud 352' are in electrical communication with the first conductive portion 906 and the threads 358 of the second stud 352 are in electrical communication with the second conductive portion 916. Of course, as with any other embodiments according to the present invention, any and/or all apertures open to a conductive surface after securing the conductors 900 may be sealed, such as with silicone, or an insulative plug, such as that 564 shown in FIG. 12.

Figure 11A:
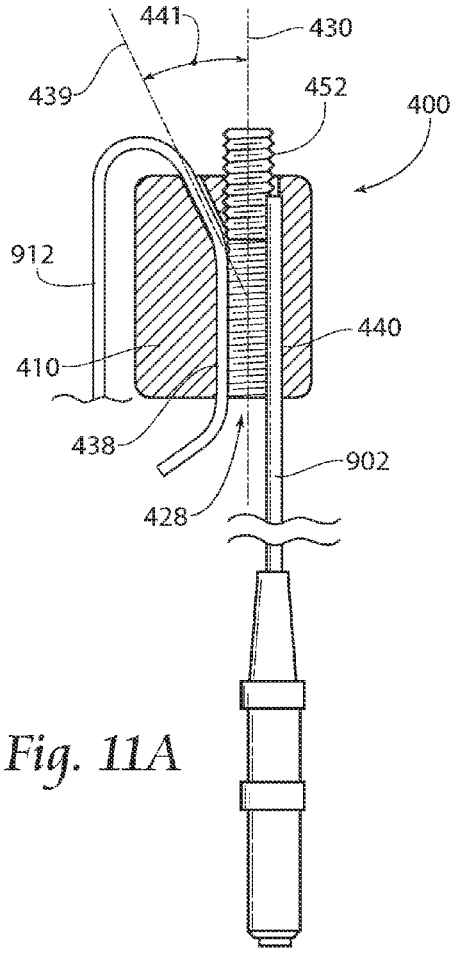
FIG. 11A is a first partial cross-section view of a fourth embodiment of an insulation displacement connector according to the present invention.
Figure 11B:
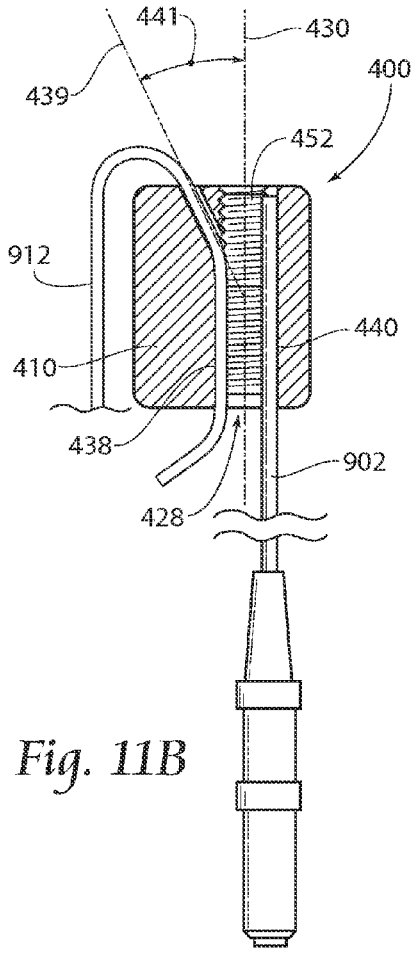
FIG. 11B is a second partial cross-section view of the embodiment of FIG. 11A.

FIGS. 11A and 11B depict a fourth embodiment 400 of a connector according to the present invention, where like numerals refer to like structure from the first embodiment 100. The fourth embodiment 400 is largely similar to the second embodiment 200, but the first conductor axis 439 is disposed at an angle 441 that is oblique, preferably acute, to the engagement axis 430. Thus, the first conductor aperture 438 extends from an outside surface of the connector body 410, such as the front surface 412 or rear surface 414, into the engagement aperture 428.

Figure 12:
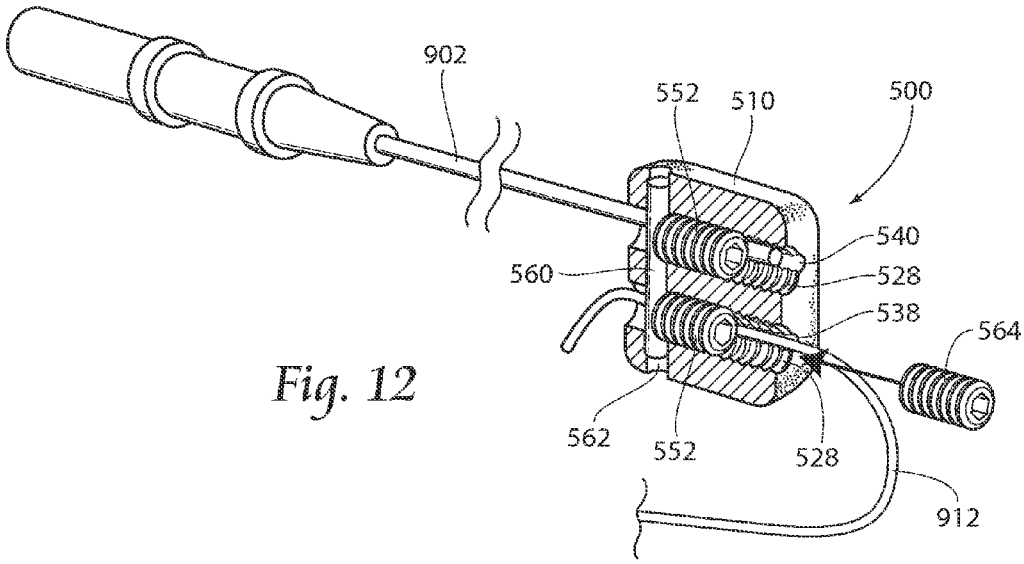
FIG. 12 is a perspective partial cross-section assembly view of a fifth embodiment of an insulation displacement connector according to the present invention.

A fifth embodiment 500 of a connector according to the present invention is shown in FIG. 12, where like numerals refer to like structure from the first embodiment 100. This embodiment 500, instead of having only a single engagement aperture 528, has two engagement apertures 528, each of which interfaces only the first conductor 902 or the second conductor 912. However, extending between and into the two engagement apertures 528 is an electrically conductive current bridge member 560. The bridge member 560 may be formed of a piece of electrically conductive material in a substantially rod or pin shape that is either molded into the connector body 510, or that is inserted into the body 510 such as through a bridge aperture 562 that may be formed obliquely to the engagement apertures 528. In this way, each coupling stud 552 is advanced into its respective engagement aperture 528 until the first end 552*a* abuts the bridge member 560. This arrangement establishes an electrical current flow path between the first conductive portion 904, one of the studs 552, the bridge member 560, the other stud 552 and the second conductive portion 914. An electrically insulative plug member 564 may be provided to be inserted into either or both engagement apertures 528.

Figure 13:
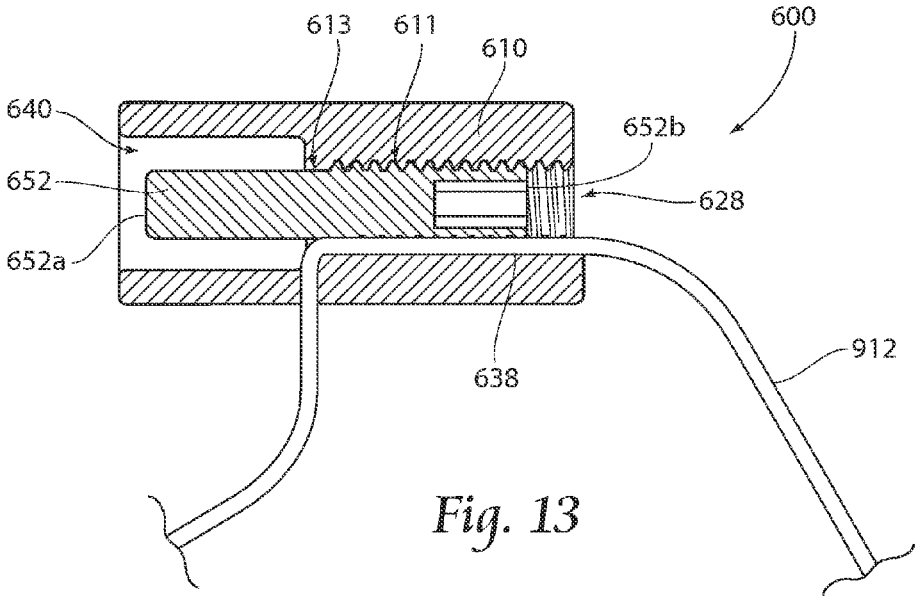
FIG. 13 is a partial cross-section view of a sixth embodiment of an insulation displacement connector according to the present invention.

FIG. 13 depicts a sixth embodiment 600 of a connector according to the present invention, where like numerals refer to like structure from the first embodiment 100. This embodiment 600 features a connector body 610 that may be formed in the fashion of a standardized connector, such as a portion of a DIN-42802 touchproof connector. This embodiment 600 includes an engagement aperture 628 and a first conductor channel 638. The coupling member 650 is a coupling stud 652 having a first end portion 652*a*. The first end portion 652*a* is formed into a standard conductive plug or jack member. The stud 652 is preferably threaded into the engagement aperture 628. However, the engagement aperture 628 preferably includes a threaded portion 611 and a nonthreaded portion 613. The non-threaded portion 613 provides a stop mechanism to ensure that the stud 652 is longitudinally disposed in the correct position. That is, the non-threaded portion 613 prevents further advancement of the stud 652 through the engagement aperture 628.

Figure 14:
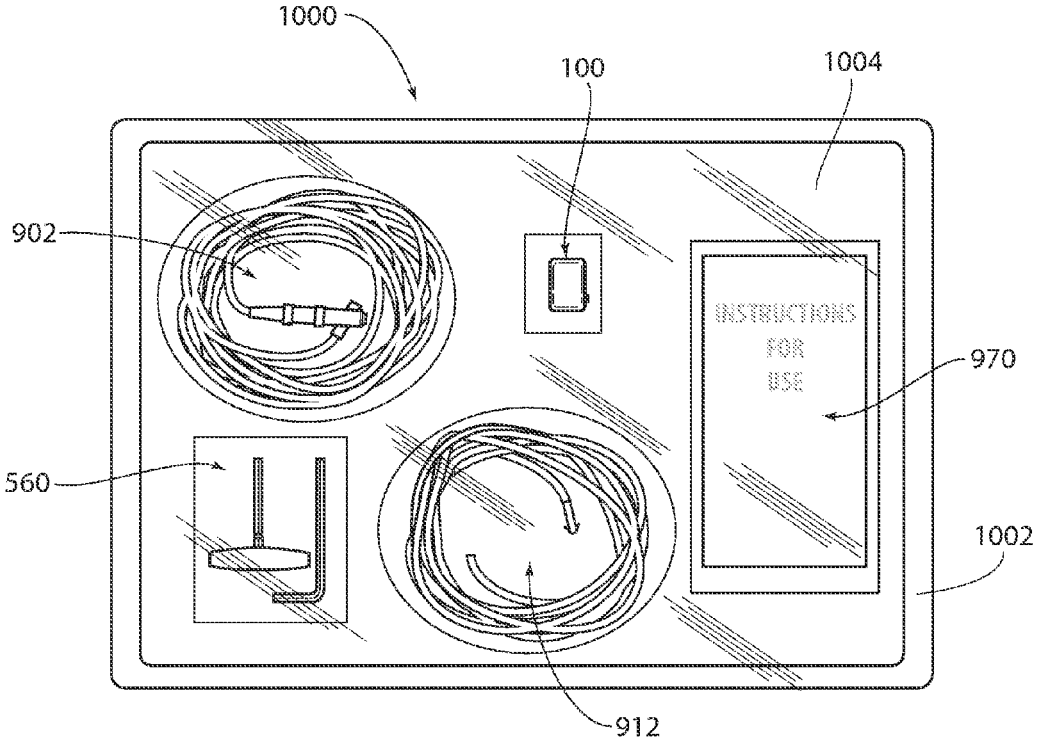
FIG. 14 is a top plan view of a kit according to the present invention.

A first embodiment 1000 of a kit according to the present invention is shown in FIG. 14. Generally, the kit 1000 includes at least a connector 100 according to the present invention and one or more wrenches 560. Further, the kit 1000 may include a first conductor 902, a second conductor 912, and/or instructions 970 for use of one or more components of the kit 1000. If provided in the kit 1000, the first conductor 902 is preferably unterminated or terminated with a terminal 908 as previously described at one end, and is preferably terminated with a plug, socket or jack at the other end, such as a DIN-42802 touchproof connector. The first conductor 902 may be provided in the kit 1000 already coupled to the connector 100, such as by being inserted into the second conductor bore 140. If the first conductor 902 is provided in an unterminated state, a terminal 908 may also be provided for being crimped or otherwise electrically coupled to the first conductive portion 904. A crimping tool (not shown) may also be provided in the kit 1000. If provided in the kit 1000, the second conductor 912 is preferably a coiled conductor having an at-rest turns-per-inch count, which is unterminated on one end and is terminated with a stimulating electrode at the other end. Preferably, if the second conductor 912 is provided in the kit 1000, and if the second conductor 912 is a coiled conductor having an at-rest turns-per-inch count, the provided connector 100 preferably includes a threaded stud 152 as a coupling member, where the threads-per-inch of the stud 152 approximate the turns-per-inch of the second conductor 912. If provided in the kit 1000, the one or more wrenches 560 preferably are selected from the group including an L-shaped hex wrench and a T-shaped hex wrench. The provided wrench(es) 560 may further include a breakaway feature that would indicate when a coupling stud 152 in is tightened to within a predetermined range or to a predetermined torque. Alternatively, a breakaway wrench may be provided pre-anchored to the stud 152. If a plurality of wrenches including a breakaway indication is provided, each wrench in the plurality of wrenches may have an expected breakaway torque level that is substantially the same, or one or more of the wrenches 560 may have different breakaway torque levels. If provided in the kit 1000, the instructions 970 generally guide a user through the use of the various components included in the kit 1000, possibly in connection with conductors not included in the kit 1000. The instructions 970 may be step-by-step instructions printed on a substrate, such as paper, or recorded on a data medium, such as audio and/or video instructions recorded on a tape or optical disc, such as a CD-ROM or DVD, or other nonvolatile memory such as a universal serial bus (USB) Flash® drive.

Generally, the components of the kit 1000 are preferably disposed in the same package, bag or box. A preferred kit 1000 includes a segmented plastic tray 1002, wherein each compartment holds one or more components of the kit 1000. A perimeter of a top edge of the tray 1002 may be sealed by, for example, a plastic sheeting material 1004 that is adhered to or otherwise bonded to the tray 1002. The compartment formed by the package, bag or box of the kit, such as the one or more compartments formed by the tray 1002 and the plastic sheeting material 1004, may be and preferably are sterile.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A device for coupling electrical conductors, the device comprising:

a connector body;

a first conductive surface disposed at least partially within the connector body;

a coupling element movably engageable at least partially within the connector body; and a first aperture formed into the connector body and adapted to receive an insulated electrical conductor;

wherein at least a first portion of the coupling element extends into the first aperture and at least a second portion of the coupling element is engageable with the first conductive surface;

wherein the coupling element is movable between a first position wherein the coupling element is in electrical communication with the first conductive surface, and a second position wherein the coupling element is spaced from and removed from electrical communication with the first conductive surface;

wherein the first aperture is formed along a first aperture axis, the device further comprising:

an engagement aperture formed into the connector body along an engagement aperture axis, wherein the coupling element is movable within the engagement aperture and wherein the engagement aperture and the first aperture intersect at a first intersection location.

2. A device according to claim 1, wherein the connector body is formed from an electrically insulative material.

3. A device according to claim 1, wherein the coupling element is movable between a first position wherein the coupling element is in electrical communication with the first conductive surface, and a second position wherein the coupling element is spaced from and removed from electrical communication with the first conductive surface.

4. A device according to claim 1, wherein when the coupling element is in the second position, the first aperture, the first intersection location and at least a portion of the engagement aperture are configured to allow passage of an insulated electrical conductor therethrough.

5. A device according to claim 1, wherein the connector body is substantially parallelepiped in shape and has at least one imperforate outer surface.

6. A device according to claim 5, wherein the connector body has at least two imperforate outer surfaces.

7. A device according to claim 6, wherein the connector body has at least three imperforate outer surfaces.

8. A device according to claim 1, wherein the engagement aperture axis and the first aperture axis are substantially parallel.

9. A device according to claim 8, the device further comprising a second aperture formed into the connector body, wherein the second aperture intersects the engagement aperture at a second intersection location.

10. A device according to claim 9, wherein the second intersection location is spaced from the first intersection location by a conduction span distance.

11. A device according to claim 10, wherein the coupling element comprises a substantially cylindrical stud formed along length disposed along a stud axis, wherein the stud length is greater than the conduction span distance.

12. A device according to claim 11, wherein the stud is threadably engaged with the connector body in the engagement aperture.

13. A method of coupling electrical conductors, the method comprising the steps of:

providing a device comprising:

a connector body;

a first conductive surface disposed at least partially within the connector body;

a coupling element movably engageable at least partially within the connector body; and a first aperture formed into the connector body and adapted to receive an insulated electrical conductor;

wherein at least a first portion of the coupling element extends into the first aperture and at least a second portion of the coupling element is engageable with the first conductive surface;

inserting an insulated electrical conductor into the first aperture, the insulated electrical conductor comprising one or more electrical conductors at least partially surrounded by one or more insulation layers;

moving the coupling element relative to the connector body; and as a result of the moving step, placing the insulated electrical conductor in electrical communication with the first conductive surface;

wherein the coupling element is movable between a first position wherein the coupling element is in electrical communication with the first conductive surface, and a second position wherein the coupling element is spaced from and removed from electrical communication with the first conductive surface;

wherein the first aperture is formed along a first aperture axis, the device further comprising: an engagement aperture formed into the connector body along an engagement aperture axis, wherein the coupling element is movable within the engagement aperture and wherein the engagement aperture and the first aperture intersect at a first intersection location.

14. A method according to claim 13, wherein the conductive element is a conductive stud extending between and including a first end and a second end.

15. A method according to claim 14, wherein the conductive stud includes stud threads mateable with body threads provided in the connector body, wherein the first portion comprises the stud threads protruding radially at least partially into the first aperture, and further wherein the moving step comprises the step of applying a rotational force to the first end of the stud, thereby causing longitudinal movement of the stud within the connector body.

16. A method according to claim 15, wherein as a result of the moving step, the stud threads penetrate one or more of the insulation layers and the stud threads are placed in electrical contact with one or more of the electrical conductors.

17. A method according to claim 16, wherein the second portion comprises the second end of the stud and, as a result of the moving step, the second end of the stud abuts and is placed in electrical communication with the first conductive surface.

* * * * *